US009849718B1

(12) United States Patent
Garrett

(10) Patent No.: US 9,849,718 B1
(45) Date of Patent: Dec. 26, 2017

(54) BEADING DESIGN TOOL

(71) Applicant: Orly Garrett, San Diego, CA (US)

(72) Inventor: Orly Garrett, San Diego, CA (US)

( * ) Notice: Subject to any disclaimer, the term of this patent is extended or adjusted under 35 U.S.C. 154(b) by 0 days.

(21) Appl. No.: 15/458,658

(22) Filed: Mar. 14, 2017

(51) Int. Cl.

| | |
|---|---|
| ***A47B 57/00*** | (2006.01) |
| ***B44C 5/00*** | (2006.01) |
| ***A47B 13/16*** | (2006.01) |
| ***A47B 23/00*** | (2006.01) |

(52) U.S. Cl.
CPC ..... *B44C 5/00* (2013.01); *A47B 13/16* (2013.01); *A47B 23/001* (2013.01)

(58) Field of Classification Search
CPC ..... B44C 5/00; A47B 13/16; A47B 23/001
See application file for complete search history.

(56) References Cited

U.S. PATENT DOCUMENTS 1,995,943 A * 3/1935 Ritch ..... A47B 13/16 108/26
2,102,746 A * 12/1937 Reilly ..... B44C 1/10 29/10
2,149,363 A * 3/1939 Rivkin ..... G09F 13/06 40/452
3,274,727 A * 9/1966 Zander ..... A63F 9/06 273/282.1
3,638,587 A * 2/1972 Uyeda ..... A47B 13/16 108/152
4,010,696 A * 3/1977 Priesman ..... A47B 23/001 108/129
4,016,183 A * 4/1977 Wallach ..... A63F 9/06 156/63
4,275,028 A * 6/1981 Cohen ..... B29C 67/04 156/196
4,926,758 A * 5/1990 Lilly ..... A47B 23/001 108/115
4,953,473 A * 9/1990 Tomaka ..... A47B 23/001 108/127
4,972,781 A * 11/1990 Montgomery ..... A47B 3/08 108/19
5,055,081 A * 10/1991 Nayak ..... A63H 33/04 108/26
5,421,270 A * 6/1995 Kelly ..... A47B 13/16 108/159
6,686,021 B1 * 2/2004 Case ..... D04D 7/02 269/47
8,857,059 B2 * 10/2014 Bizzotto ..... B23P 11/00 29/10

(Continued)

*Primary Examiner* — Hanh V Tran

(57) ABSTRACT

The Beading Design Tool is a tool for creating bead designs utilizing the actual beads intended for the design. The beads are arranged on the Beading Design Tool, either in straight stitch or offset stitch configuration. The Beading Design Tool can accommodate various sized beads. The beader can easily alter a design, or correct an error, by simply removing those beads no longer wanted in the design and replacing them with other beads. Manipulating the design is easy and fast. Upon completion of the creation, the beader may transpose the beads on the Beading Design Tool to the loom, or free hand composition, thereby minimizing the possible error of adding, deleting a bead or selection of an incorrect color. The beader may also elect to keep the design on the Beading Design Tool as a guide and create the finished piece using a second set of beads.

2 Claims, 7 Drawing Sheets

(56) References Cited

U.S. PATENT DOCUMENTS

Figure 1:
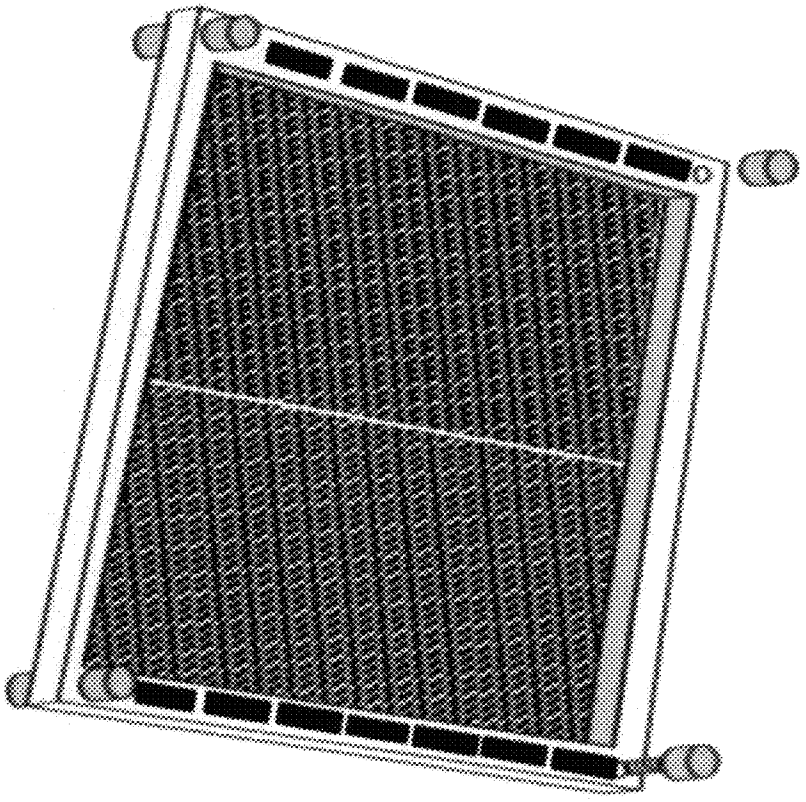

| | | | | |
|---|---|---|---|---|
| 2008/0115534 | A1* | 5/2008 | Kernan | B44C 3/123 65/36 |
| 2011/0192544 | A1* | 8/2011 | Reynolds | A63H 33/001 156/500 |
| 2012/0175037 | A1* | 7/2012 | Bauvin | B44C 1/162 156/60 |
| 2014/0209116 | A1* | 7/2014 | Seibt | B44C 3/12 132/275 |

* cited by examiner

BEADING DESIGN TOOL

(1) BACKGROUND OF THE INVENTION

The field of endeavor for this invention is related to beadwork, specifically a tool to be used in the creation of beading designs.

Beads are defined as small pieces of glass, stone, plastic or other materials, typically rounded and perforated for threading with other beads, to form designs. Beading is the process by which beads are strung together to create a multitude of final products. Many beading products are weaved, that is, formed by interlacing long threads passing in one direction with others at a right angle to them, either on a loom or free hand. The resultant products are used for, and as, but not limited to, necklaces, earrings, bracelets, belts, headbands, decorative appliques, purses, etcetera. These beaded products are of varying widths and lengths. There are a variety of stitches used in the fabrication of the beaded product. Two such examples are the straight/square stitch, wherein the beads are aligned in horizontal straight rows; and the staggered peyote/brick/Comanche stitch, in which the bead rows are offset to each other in horizontal rows.

As general information, beads are available in a multitude of sizes, with sizes designated by the number of beads, when stood on edge, that fit within an inch. The larger the bead size, the smaller the number designation. Size 11 bead, also designated as 11/0, or 11", is commonly used in beading, however available sizes range from 22/0 to 6/0. The cited size designations are nominal, as different bead manufactures may vary slightly in size while calling a bead, for example, 11/0. For other design and application purposes, beads are available in many more sizes and shapes.

Beads are available not only in a wide variety of sizes, but also a wide variety of colors, and bead designs are limited only by the constructing person's (the beader's) imagination. Thus, selection of colors, size, and ultimately the design creation requires considerable time on the part of the beader. Using the actual beads in the design process is of great benefit in translating the beader's concept to the final product.

There were no tools or devices discovered in the Prior Art search that offers the beader the ability to design a bead design with the actual, intended beads and then, if desired, transpose the design to create the physical work.

In reviewing Prior Art, it was found that there are many applications for stitching beads using various substrates and mesh materials, on which beads can be attached. In these instances, the substrate becomes an inextricable part of the finished product. There are jewelry piece castings with holes for thread used in the stringing of beads. These do not directly address the product which this invention covers.

One method creates a different type of bead with an attached projection, designed to insert into a mesh material. This requires special beads, not commonly available. Yet another method used in the design of a beaded product is a paper pattern, creating a bead design on it, adhering the paper pattern to a form, and stitching the beads directly over the beading pattern surface. The drawbacks to this particular approach are; a) need of multiple coloring pencils which may not approximate the intended beads coloring, b) an awkward and uneven beading result.

None of these methods address the creation of a bead design with the actual, intended beads of the finished work. This invention is a tool used in the creation of bead designs utilizing the actual, intended beads. The design may then be directly transferred to the final product by simply using needle and thread to string each bead from the Beading Design Tool to the loom or free hand creation.

There are currently several methods used in the design of a beaded product which was not located in Prior Art review. One method is using one of several software tools offered online. The beader either downloads the program or works with it online. The drawbacks to the software tool are several; a) it requires a beader to own or have access to the computer and printer, b) it requires the beader to have some knowledge of using an electronic design tool, c) the colors in the software palate often are not identical matches for the actual bead colors the beader intends to use, thus the representation of the design will not be a true representation of the intended creation, d) translation of the software version to the physical version is fraught with possible errors, not always noticeable by the beader until a fair amount of the beading work has already been done. The above (d) drawback is due to the small sizes and variances of colors of the beads, exacerbated with the constant need to shift the beader's eyes from screen or paper pattern representation of the software output to the loom or free hand physical beading. The result of this manner of execution from software representation to physical design may very easily translate to an omitted, added, or incorrect color bead, not noticeably apparent to the beader until many rows are completed. Repair of these types of errors would require the beader recognize the exact spot the error was made and to undue the beading work to the point.

Another method used in the design of a beaded product and not located in Prior Art review, is simply a paper grid, sometimes known as pattern papers, whereby the beader uses colored pencils to color individual grid boxes, thus creating the bead design. The drawbacks to this approach are: a) the need for a wide array of colored pencils which almost never approximate the colors of the intended beads, b) translation of the paper design to the physical version is fraught with possible errors, not always noticeable by the beader until a fair amount of beading work has already been done. The drawback is due to the small sizes and variances of colors of the beads, exacerbated with the constant need to shift the beader's eyes from the paper pattern to the loom or free hand physical beading. The result of this manner of execution from pattern to physical design may very easily translate to an omitted, added, or incorrect color bead, not noticeably apparent to the beader until many rows are completed. Repair of these types of erros would require the beader recognize the exact spot the error was made and to undo the beading work to the point of the error. Note paper patterns are also available with preprinted designs, however the color matching and physical execution issues remain.

Advantages of this invention are:

a. The beader will create the beading design using the actual, intended design beads, thereby eliminating the need to approximate bead color representations through other design means.
b. The beader will be able to make changes or alter the design by simply removing the bead(s) from a particular location on the tool, and rearranging the bead(s) as the beader chooses, without having to undo any other portion of the design.
c. Upon completing the bead design, the beader may choose to use the actual beads from the Beading Design Tool in the making of the beaded product. By simply using the beading needle to string the beads in the Beading Design Tool row by row, the beader can transpose the design to the loom, or use the free hand stitching technique.

d. Upon completing the bead design, the beader may also choose to create the beaded product with new beads, leaving the newly creating design on the Beading Design Tool and duplicating the design on a loom or free hand.

e. In using this Beading Design Tool, the beader has a method for bead design creation unlike any tool currently available. No substrates, special beads, software, or paper patterns are required. The creation process is constructed with the actual beads, thus reflecting the actual intended colors, and translation of the design to the final product is now less prone to beader error.

5) allow avoidance of execution errors in translating a design to physical product, as the beader can use the beads in the design tool directly onto the loom or the free hand construction.

All of the above enumerated attributes of this invention provide a beading design tool unlike any that were discovered in the Prior Art.

(3) BRIEF DESCRIPTION OF THE DRAWINGS

FIG. 1—The Beading Design Tool, Side A depiction of general design. Recessed surfaces on both sides, designated as Side A and Side B, of the tool with each side comprised of dimpled indentations. The edge along all four sides is raised, forming a frame.

12 Related Prior Art

| Pat. No. | Filing Date | Publication Date | Applicant | Title |
|---|---|---|---|---|
| U.S. 1,499,769 | Jul. 7, 1922 | Jul. 1, 1924 | Marcel Godefroy | Fabricated beadwork |
| U.S. 1,508,818 | Jul. 7, 1923 | Sep. 16, 1924 | William Poida A | Bbadwobk loom |
| U.S. 2,102,746 | Mar. 1, 1937 | Dec. 21, 1937 | Evans Case Co | Ornamentation |
| U.S. 3,545,069 | Apr. 30, 1968 | Dec. 8, 1970 | Krieger Bernard L | Method and means of stringing beads |
| U.S. 3,708,862 | Jun. 10, 1971 | Jan. 9, 1973 | E Powell | Method of stringing beads |
| U.S. 4,016,183 | Apr. 17, 1972 | Apr. 5, 1977 | Wallach Alfred H | Bead with a projection |
| U.S. 5,292,255 | Nov. 30, 1992 | Mar. 8, 1994 | Goldwasser Solomon P | Beaded picture kit and method |
| U.S. 5,494,734 | Jan. 18, 1994 | Feb. 27, 1996 | Widders; Cat A. | Technique for beaded decorative article |
| U.S. 5,562,451 | Jul. 8, 1994 | Oct. 8, 1996 | Polymerics, Inc. | Craft art product including three-dimensional bead matrix designs |
| U.S. 6,686,021B1 | May 31, 2000 | Feb. 3, 2004 | Frances Janney Case | Beading pattern surface and method for creating beadwork |
| WO 2014096979 A1 | Feb. 1, 2013 | Jun. 26, 2014 | Dee Taylor | Bead and mesh beading technique |
| U.S. 20140147614A1 | Nov. 26, 2013 | May 29, 2014 | Dee Taylor | Beaded decorative accessories and methods of making beaded decorative accessories |

13 Classifications
U.S. Classification 428/131, 29/433, 63/37, 428/207, 63/38, 428/143, 428/195, 269/47
International Classification D04D7/02
Cooperative Classification D04D7/02, Y10T29/49838, Y10T428/24802, Y10T428/24901, Y10T428/24372
European Classification D04D/02

(2) BRIEF SUMMARY OF THE INVENTION

The objective of this invention is to add a new method of beading design to the methods of beading design as discussed in above paragraphs.

The beader will create a beaded design one bead at a time, by placing their chosen bead size and color into a dimpled indentation, one bead per dimpled indentation. The beader will determine the overall size of the design by deciding how many dimpled indentations to populate with beads. As the beader populates the individual dimpled indentations, the design is created.

The use of this Beading Design Tool will:

1) allow the beader to create bead designs for both straight and staggered configured stitches,
2) allow the beader to create a bead design utilizing a range of bead sizes,
3) allow the beader to create bead designs using the actual intended beads, thereby capturing an exact coloring of the finished piece,
4) allow creation of a beaded design while providing the versatility of making unlimited changes by simply removing and substituting beads in given dimpled indentations, thus avoiding software changes, erasing colored pencil marks, and removal of erroneous bead work from semi-permanent devices such as substrates and mesh.

Figure 1A:
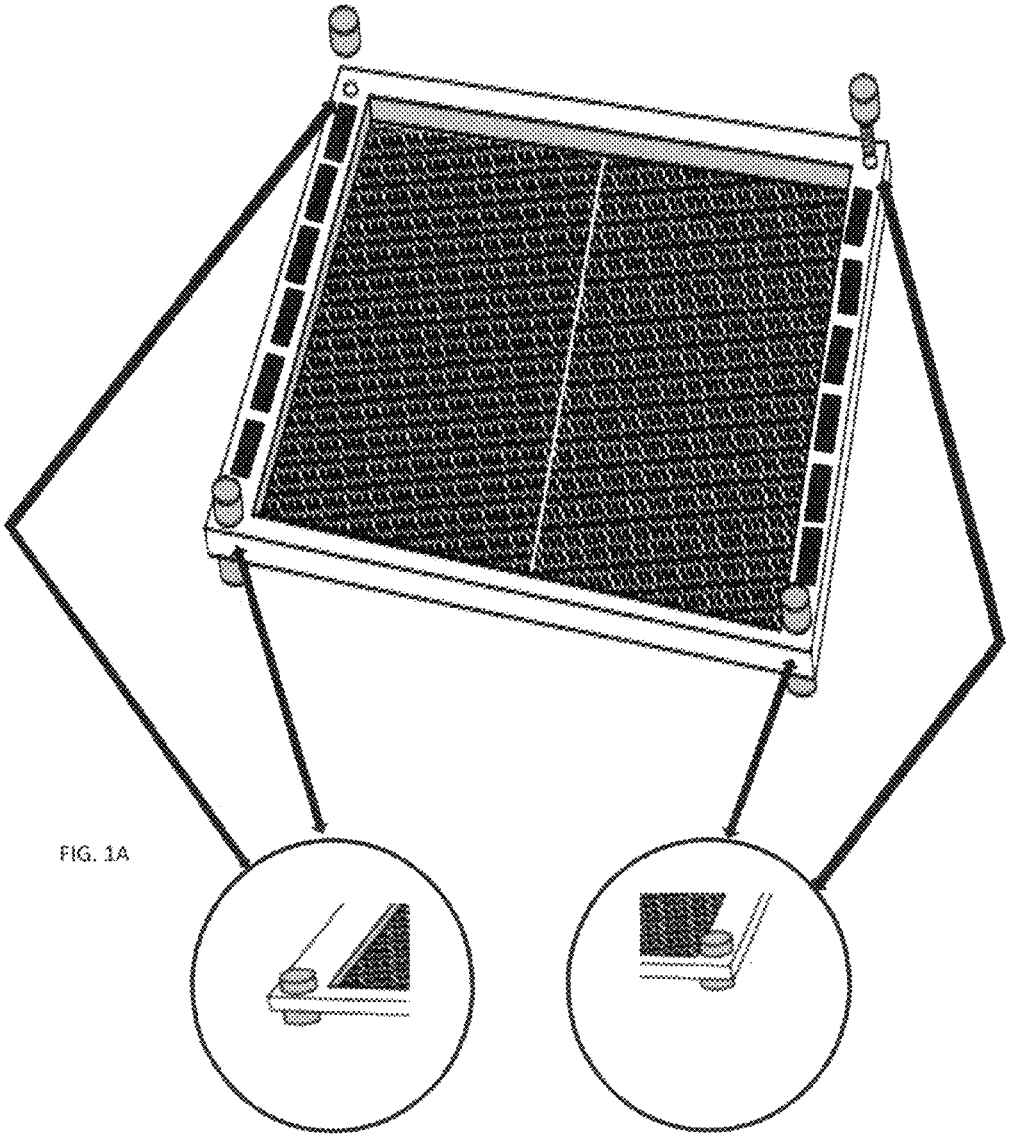

FIG. 1A—Feet on all four corners on both Side A and Side B.

Figures 1B, 1C:
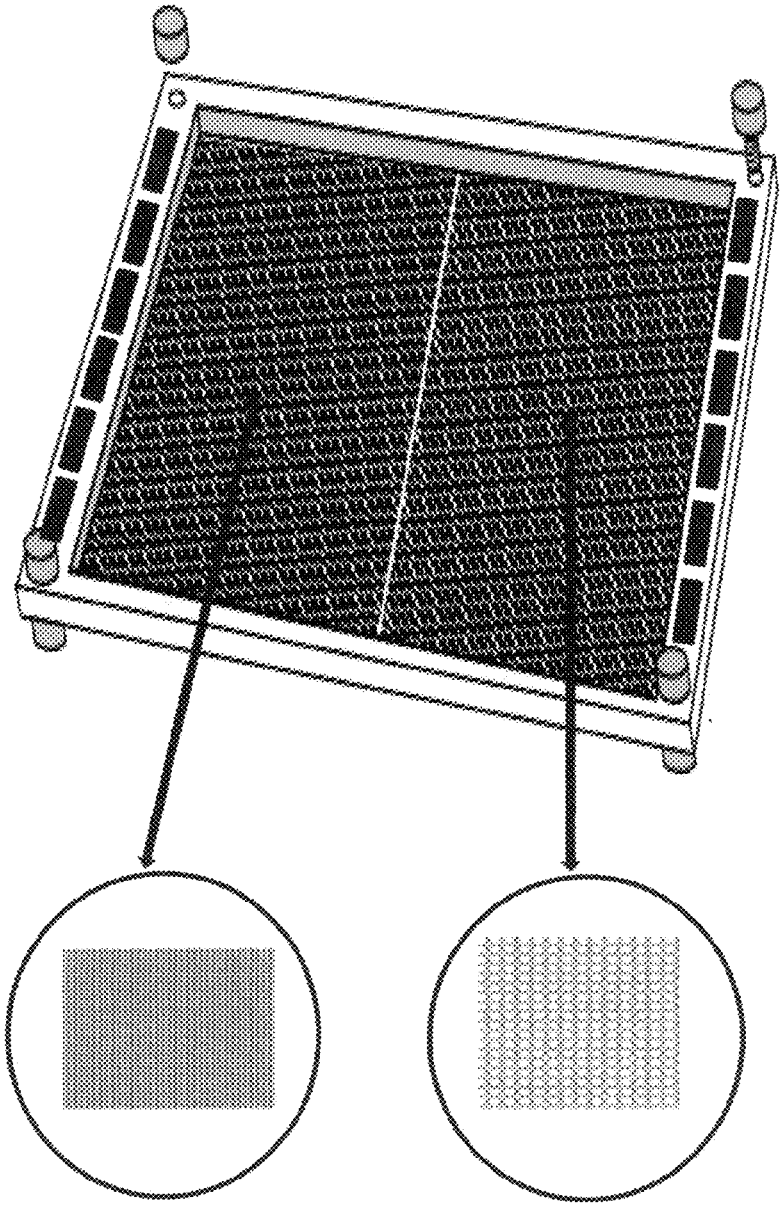

FIG. 1B—Side A, smaller dimpled indentations, straight rows across, covering half of the recessed surface.

FIG. 1C—Side A, larger dimpled indentations, straight rows across, covering half of the recessed surface.

Figure 2:
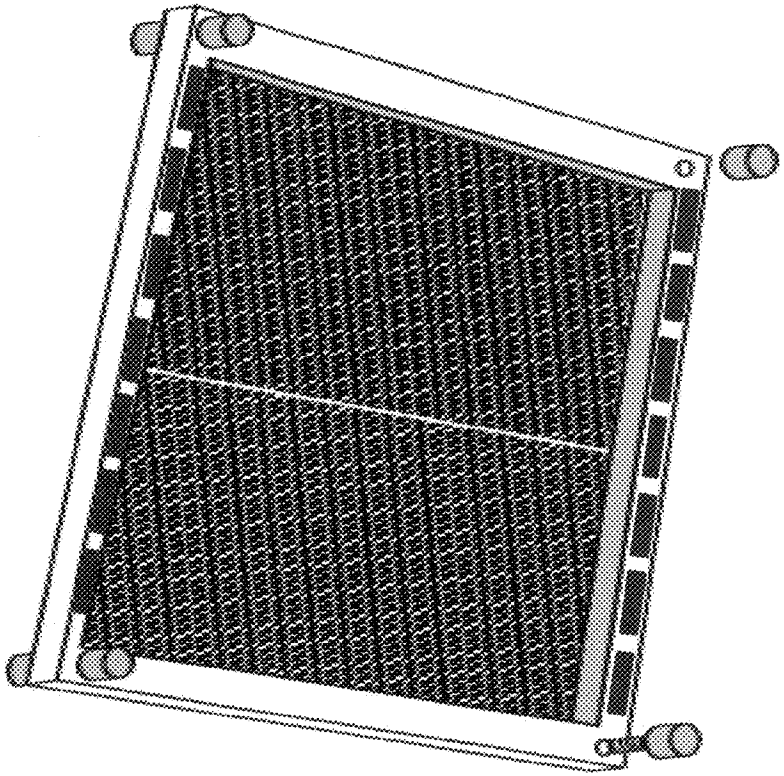

FIG. 2—The Beading Design Tool, Side B depiction of general design. Recessed surfaces on both sides, designated as Side A and Side B, of the tool, with each side comprised of dimpled indentations. The edge along all four sides is raised, forming a frame.

Figures 2A, 2B:
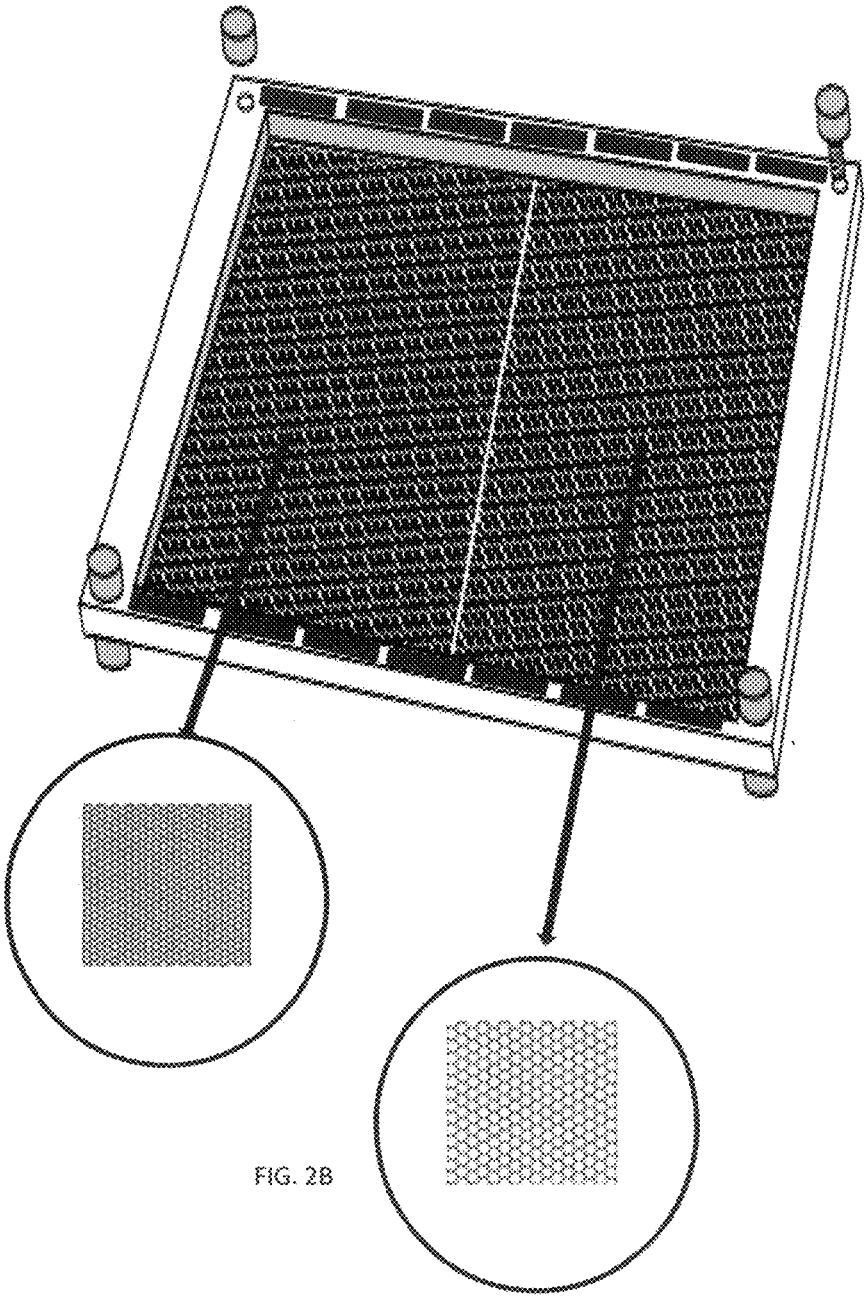

FIG. 2A—Side B, smaller dimpled indentations, staggered rows across, covering half of the recesses surface.

FIG. 2B—Side B, larger dimpled indentations, staggered rows across, covering half of the recessed surface.

Figure 3:
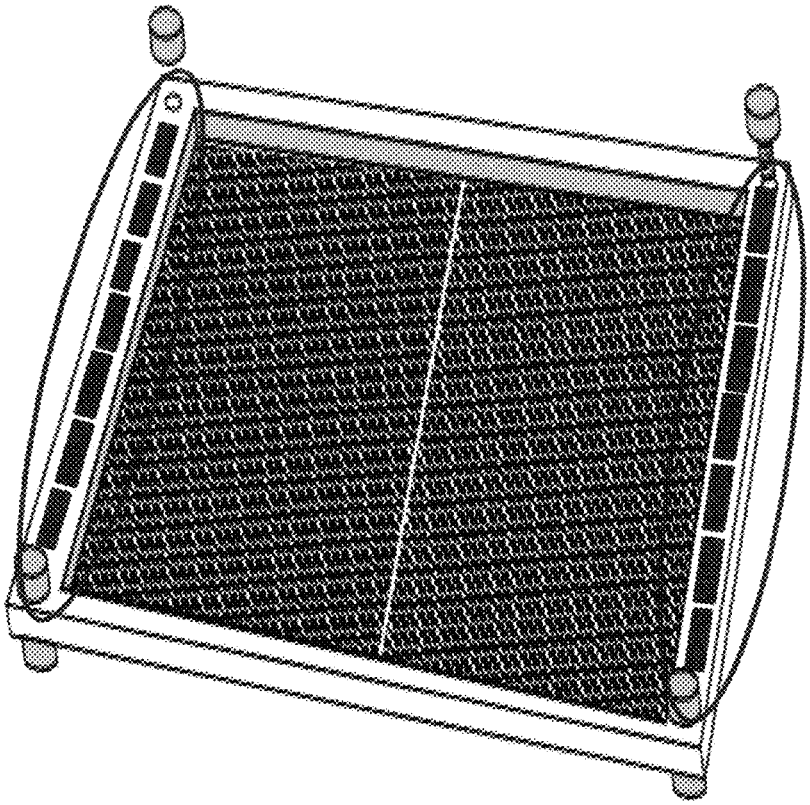

FIG. 3—Side A, individual bead channels on frame on both sides of Side A.

Figure 4:
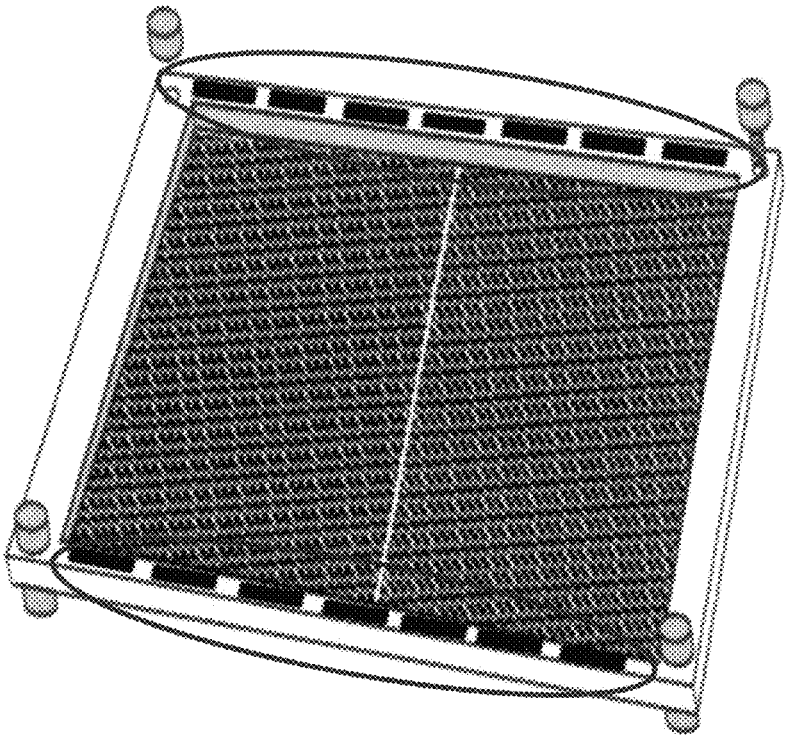

FIG. 4—Side B, individual bead channels on frame on top and bottom of Side B.

(4) DETAILED DESCRIPTION OF THE INVENTION

This invention is a double-sided board with recessed surfaces on both sides and a raised perimeter, or frame, around all four edges on both sides. There are dimpled indentations on both sides of the board, spanning the entire areas of recessed surfaces of each side. Ref. FIG. 1 and FIG.

2. There are a total of eight feet, one at each corner of each side, elevating the tool above the working area. Ref. FIG. 1A.

Side A of the board contains two sized dimpled indentations. On the right side are slightly larger dimpled indentations to accommodate larger bead sizes, and on the left side of the board, the dimpled indentations are slightly smaller to accommodate smaller bead sizes. Side A dimpled indentations are aligned in a straight horizontal rows across the recessed area, allowing the beader create a straight configured stitch bead design. Ref. FIG. 1B and FIG. 1C.

Side B is identical to Side A with the sole exception that the dimpled indentations of the horizontal rows across the recessed area are staggered, or offset, so the beader can create a peyote/brick/Comanche stitch design. The larger dimpled indentations are on the right, to accommodate larger bead sizes, and the smaller dimpled indentations are on the left side of board, to accommodate smaller bead sizes. Ref FIG. 2A and FIG. 2B.

Contained within the raised perimeter, or frame, on both Sides A and B are individual recessed channel features. Side A channels are located on the left and right sides. The channels are multiple individual pockets. The frame serves a dual purpose of preventing beads from rolling off the tool and providing storage wells for beads in approximately of the design work being created on the tool. Ref. FIG. 3.

Side B channels are located in the frame on the top and bottom. Ref. FIG. 4.

What is claimed is:

1. A unibody tool to be used in the creation of bead designs for nominally sized beads between 6/0 to 22/0 comprised of:

a dual-sided board with recessed platforms on both sides, wherein both recessed sides have dimpled indentations in at least two different configurations of straight and staggered or offset rows (straight and staggered, or offset rows), and each side has a uniquely sized dimple indentation different from the other side, raised peripheral frames on all four edges on each side with discreet channels within the frame to store beads intended for use in the design process, and feet in all four corners of each side, eight in total, to elevate the tool above the working area.

2. The unibody tool as claimed in claim 1, wherein the discreet channels have different sizes.

* * * * *